US007300297B1

(12) United States Patent
Wang

(10) Patent No.: US 7,300,297 B1
(45) Date of Patent: Nov. 27, 2007

(54) POWER SUPPLY WITH A CHANGEABLE PLUG

(75) Inventor: Wen-Feng Wang, Taipei (TW)

(73) Assignee: Sunfone Electronics Co., Taipei (TW)

( * ) Notice: Subject to any disclaimer, the term of this patent is extended or adjusted under 35 U.S.C. 154(b) by 0 days.

(21) Appl. No.: 11/509,800

(22) Filed: Aug. 25, 2006

(51) Int. Cl.
*H01R 29/00* (2006.01)

(52) U.S. Cl. ..... 439/173

(58) Field of Classification Search ..... 439/172, 439/518, 171, 173, 174, 175, 956, 218, 52, 439/53

See application file for complete search history.

(56) References Cited

U.S. PATENT DOCUMENTS 5,613,863 A * 3/1997 Klaus et al. ..... 439/131
6,109,977 A * 8/2000 Baxter et al. ..... 439/693
6,227,888 B1 * 5/2001 Hahn ..... 439/173
6,749,451 B2 * 6/2004 Schmitt ..... 439/218
7,008,246 B2 * 3/2006 Zhuge ..... 439/173
7,179,105 B1 * 2/2007 Hung ..... 439/172
2003/0076204 A1 * 4/2003 Whipple et al. ..... 335/202
2004/0110413 A1 * 6/2004 Brandstatter et al. ..... 439/518
2007/0032109 A1 * 2/2007 Hung ..... 439/172

* cited by examiner

*Primary Examiner*—Chandrika Prasad
(74) *Attorney, Agent, or Firm*—Ming Chow; Sinorica, LLC

(57) ABSTRACT

A power source supplier able to change its plug includes a main body and a plug. The main body has a recess provided with a plug engage block and plural elastic conducting strips. The recess has the opposite sides of its lower side bored with two position-limiting notches. The main body is further provided with a press button having its free end disposed with an elastic clasping member in the recess. The plug fitted with the main body has its rear side bored with a plug engage slot and plural connecting slots for receiving the plug engage block and the elastic conducting strips, and its periphery fixed with two engage members matching with the position-limiting notches. The plug is provided with a connecting block having a rear engage groove for receiving the clasping member. Thus, different-structured plugs can be easily and accurately assembled on the main body.

10 Claims, 8 Drawing Sheets

POWER SUPPLY WITH A CHANGEABLE PLUG

BACKGROUND OF THE INVENTION

1. Field of the Invention

This invention relates to a power source supplier, particularly to one able to assemble and change its plug with easiness.

2. Description of the Prior Art

A conventional power source supplier 10, as shown in FIG. 1, includes a main body 11 and a plug 12 that can be changed according to the various plug specifications of different regions. The main body 11 is provided with a recessed slide groove 111 having two elastic conducting strips 112 oppositely positioned thereon and an elastic clasping member 113 positioned at the lower edge. The plug 12 has its bottom side formed with a slide plate 121 to be fitted in the slide groove 111 of the main body 11. The slide plate 121 has its opposite sides respectively bored with a recessed groove 122 for the two elastic conducting strips 112 of the main body 11 to slide therein. Further, the slide plate 121 of the plug 12 has its rear side provided with a protruding clasping edge 123 to be clasped with the elastic clasping member 113 of the main body 11 for fixing the plug 12 on the main body 11. Furthermore, the plug 12 is fixed thereon with insert pins of different specifications so as to match with various-specification sockets.

However, when assembled on the main body 11, the plug 12 is parallel to the main body 11 to be fitted in the slide groove 111; therefore, the bottom side of the slide plate 121 of the plug 12 is likely to press against the two elastic conducting strips 112 of the main body 12 and make the elastic conducting strips 112 deformed and unable to connect with the insert pins 124 of the plug 12, rendering the power source supplier 10 unable to function. In addition, since the insert pins 124 are directly positioned in the recessed grooves 122 and exposed to the outside; therefore, when inserting the plug 12 in a socket, a user is likely to touch the two insert pins 124 carelessly and cause an accident.

SUMMARY OF THE INVENTION

The objective of this invention is to offer a power source supplier able to change its plug, including a main body and a plug. The main body has its topside formed a recess having a plug engage block fixed therein and has its interior disposed with elastic conducting strips preset in number and protruding out of the recess. The recess has its lower end bored with two position-limiting notches preset in number at the opposite sides. Further, the main body is provided with plural press buttons having the free end disposed with a clasping member positioned in the recess. The plug to be fitted in the recess of the main body has its interior formed with an accommodating hollow and its rear side bored with a plug engage slot and plural connecting slots communicating with the accommodating hollow. The accommodating hollow of the plug has its upper side provided with plural insert pins extending toward the front end at the locations corresponding to the connecting slots and respectively connected with the elastic conducting strips of the main body. The plug engage slot of the plug is to be engaged with the plug engage block of the main body. In addition, the plug has its peripheral edge fixed at preset locations with engage blocks matching with the position-limiting notches of the main body and its rear side disposed with a connecting block corresponding to the press button and having its rear side bored with an engage groove. When the plug is fitted on the main body, the plug engage block of the main body can be restrictedly fixed in the plug engage slot of the plug, enabling the plug to be positioned accurately, and simultaneously the elastic conducting strips of the main body can be accurately fitted in the connecting slots of the plug, able to prevent the conducting elastic strips from being damaged to prolong their service life. Additionally, the insert pins are positioned at the upper end of the accommodating hollow of the plug, able to prevent a user from touching the insert pins and causing an accident.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
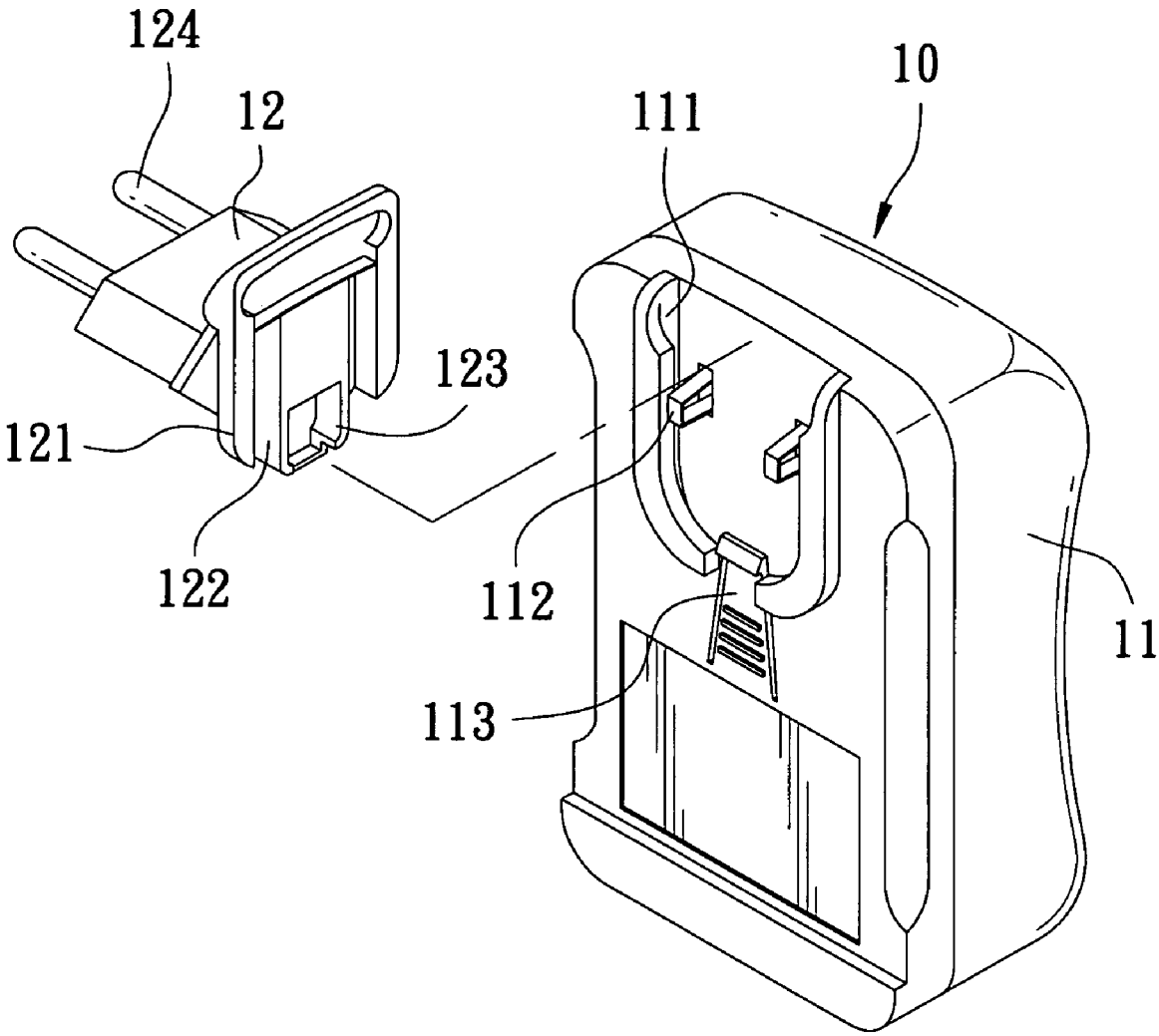
FIG. 1 is an exploded perspective view of a conventional power source supplier.
Figure 2:
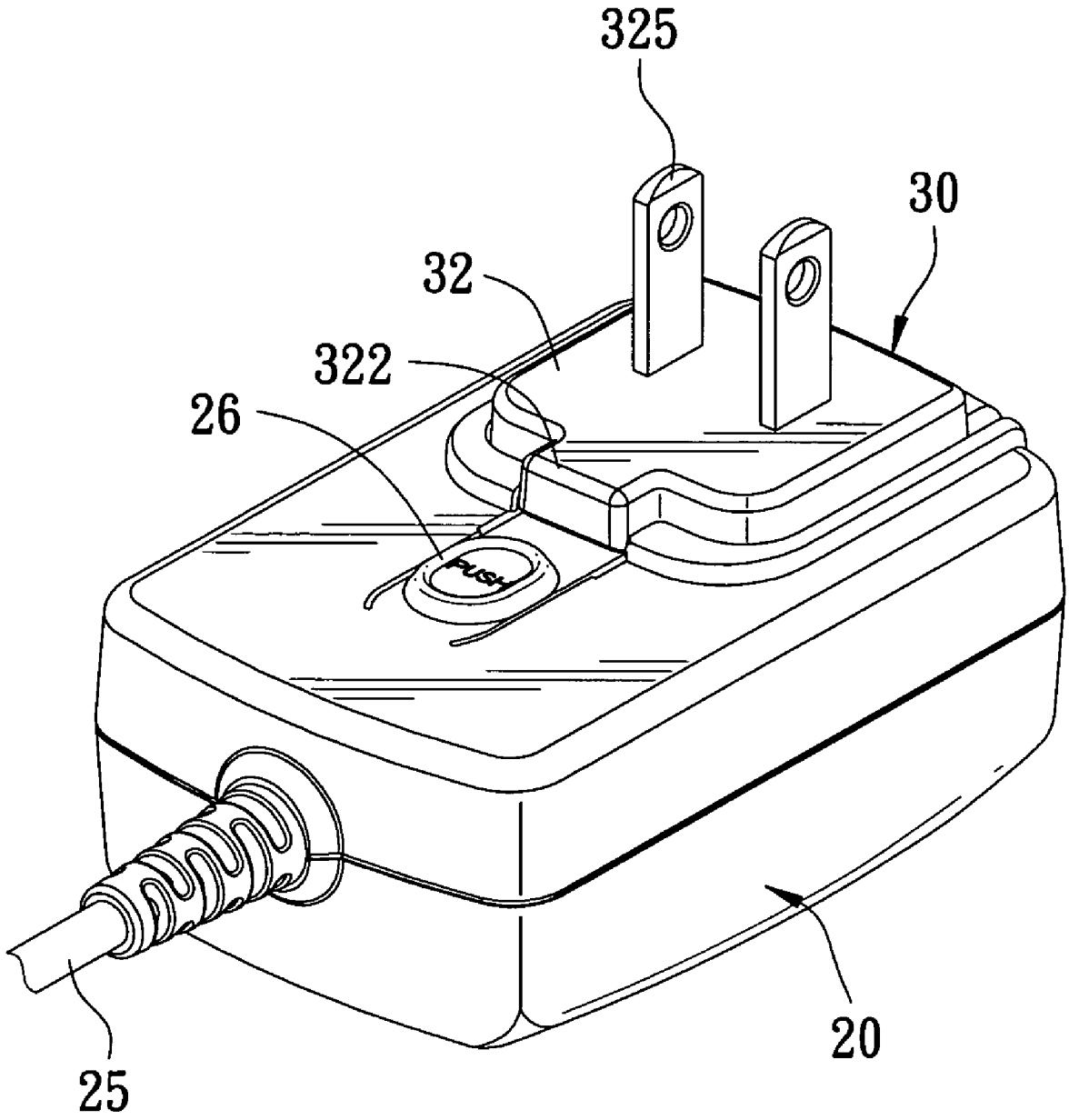
FIG. 2 is a perspective view of a first preferred embodiment of a power source supplier able to change its plug in the present invention.
Figure 3:
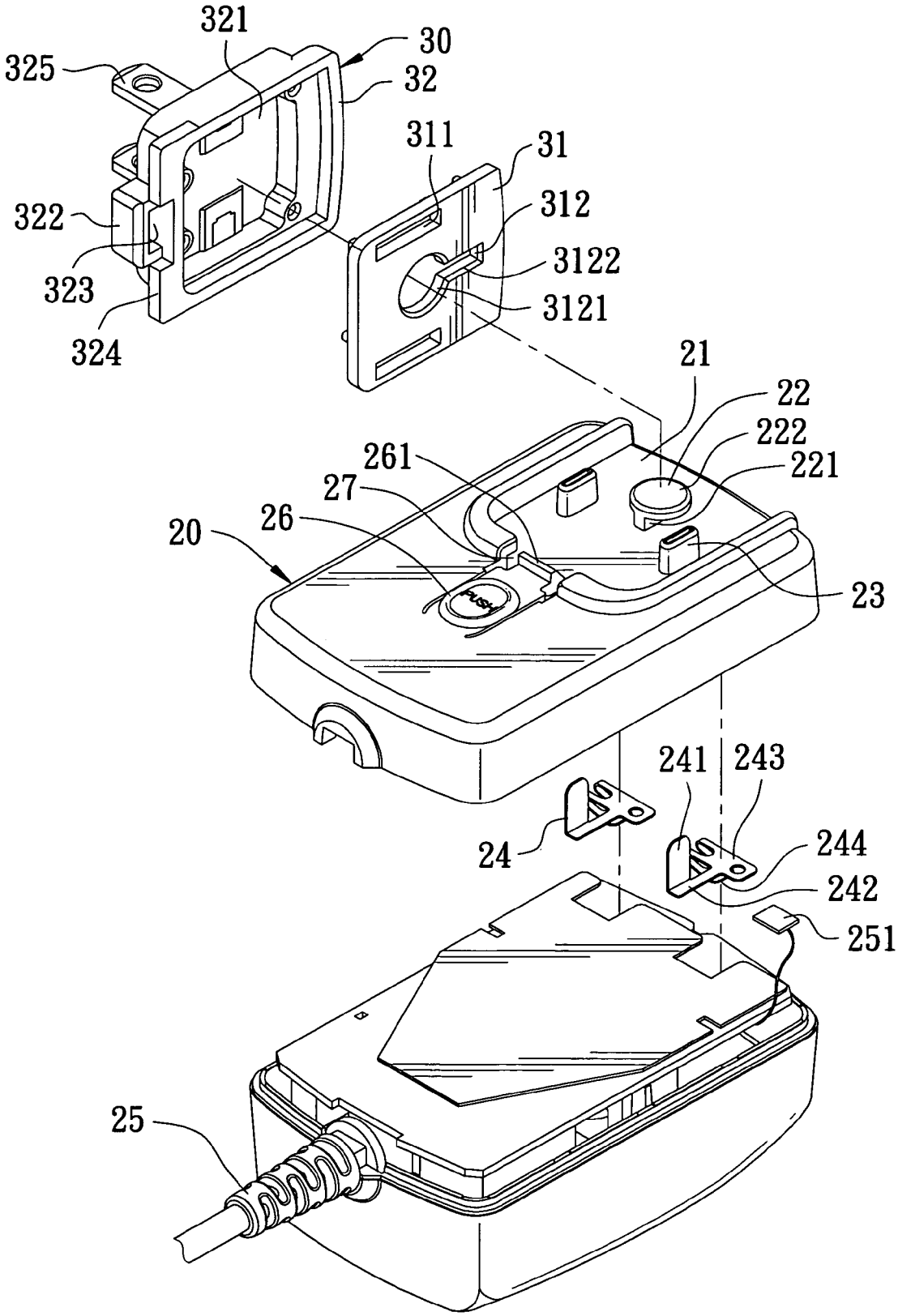
FIG. 3 is an exploded perspective view of the first preferred embodiment of the power source supplier able to change its plug in the present invention.
Figure 4:
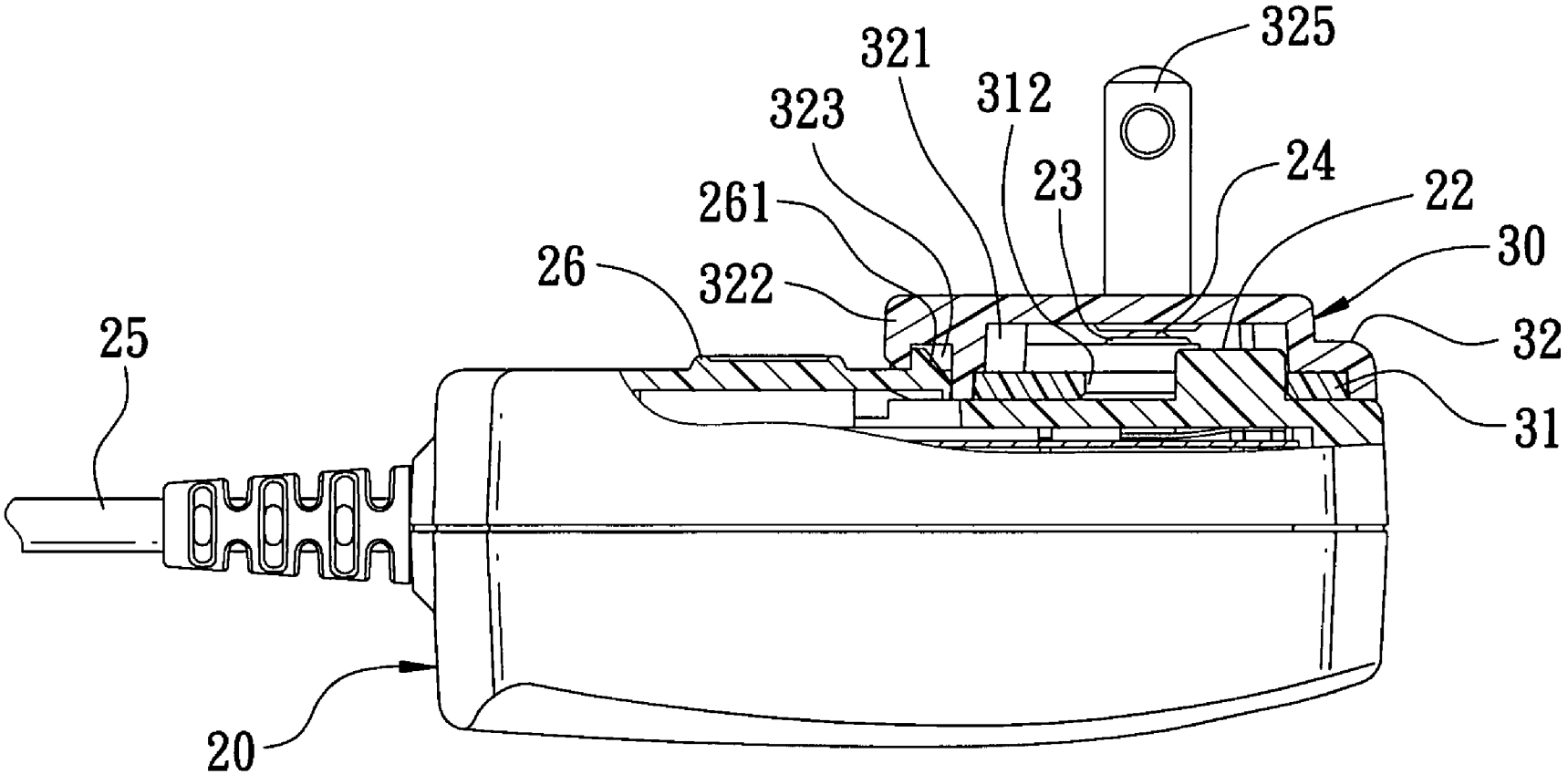
FIG. 4 is a side cross-sectional view of the first preferred embodiment of the power source supplier able to change its plug in the present invention.

A first preferred embodiment of a power source supplier able to change its plug in the present invention, as shown in FIGS. 2, 3 and 4, includes a main body 20 and a plug 30 as main components combined together.

The main body 20 has its upper front side formed with a recess 21 with a front open end. The recess 21 is provided therein with a plug engage block 22 having a coupling member 221 extending upward vertically from the bottom of the recess 21, and the coupling member 221 has its free end expanding sideward and forming a round position-limiting block 222. Further, the recess 21 is fixed thereon with two opposite hollow position-guide blocks 23 protruding upward and positioned in parallel. Two elastic conducting strips 24 are respectively fitted in the two position-guide blocks 23 from the interior of the main body 20, respectively having its upper contact end 241 somewhat protruding out of the topside of the position-guide block 23. Additionally, each elastic conducting strip 24 has its lower side extending vertically and forming an elastic member 242 having its outer end extending sideward to form a combining member 243, which has its upper side secured on the main body 20 and its lower side provided with a fit end 244 to be fitted with the fit head 251 of an electric wire 25 installed in the main body 20. In addition, the main body 20 is provided with an elastic press button 26 at the lower end of the recess 21 and the press button 26 has its free end formed with an elastic clasping member 261 positioned in the recess 21 on the same level with the front end of the main body 20. The recess 21 further has its bottom side bored with two recessed position-limiting notches 27 at the opposite sides of the clasping member 261.

Figure 5:
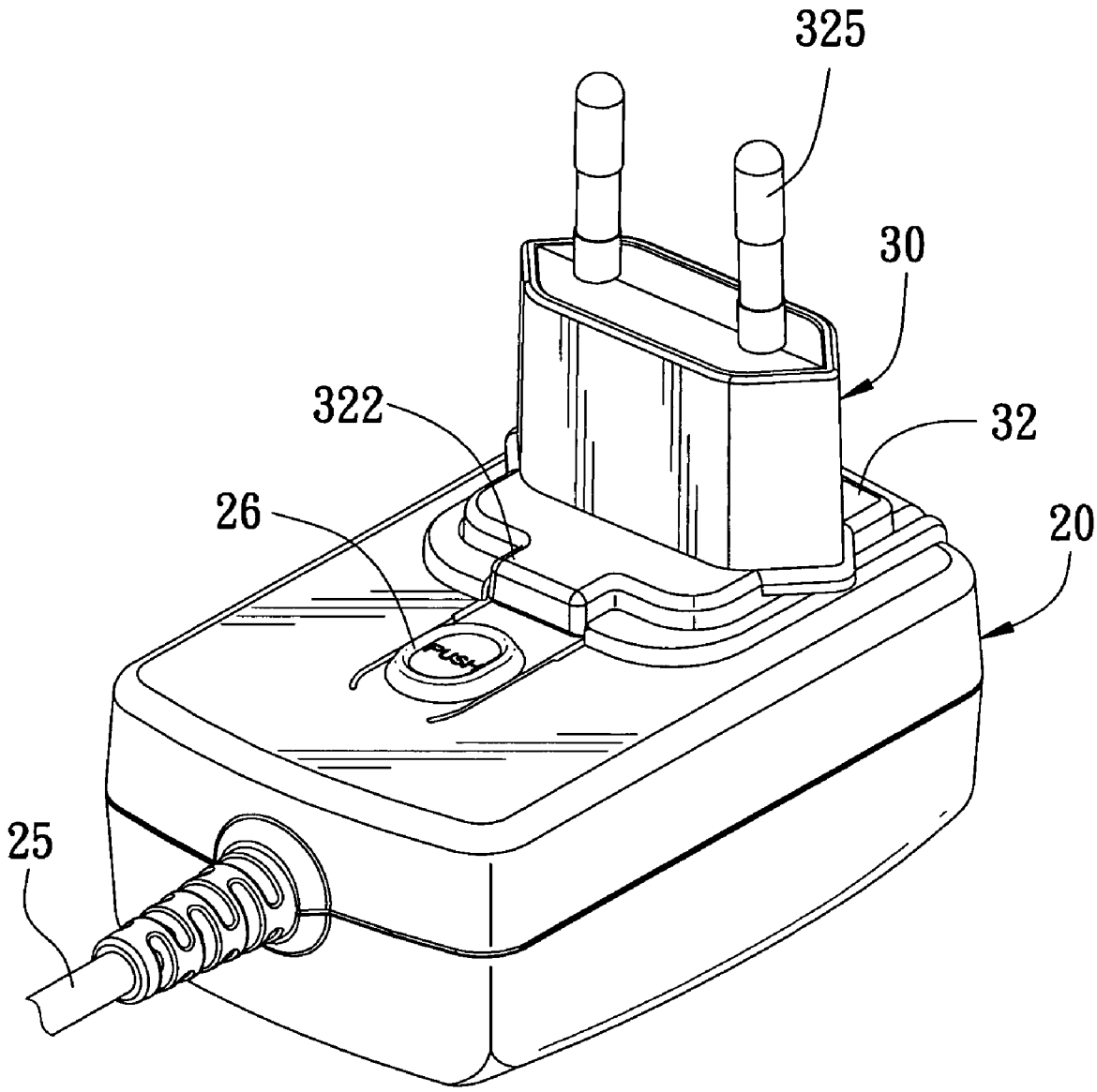
FIG. 5 is a perspective view of the first preferred embodiment of the power source supplier assembled thereon with a different-structured plug in the present invention.
Figure 6:
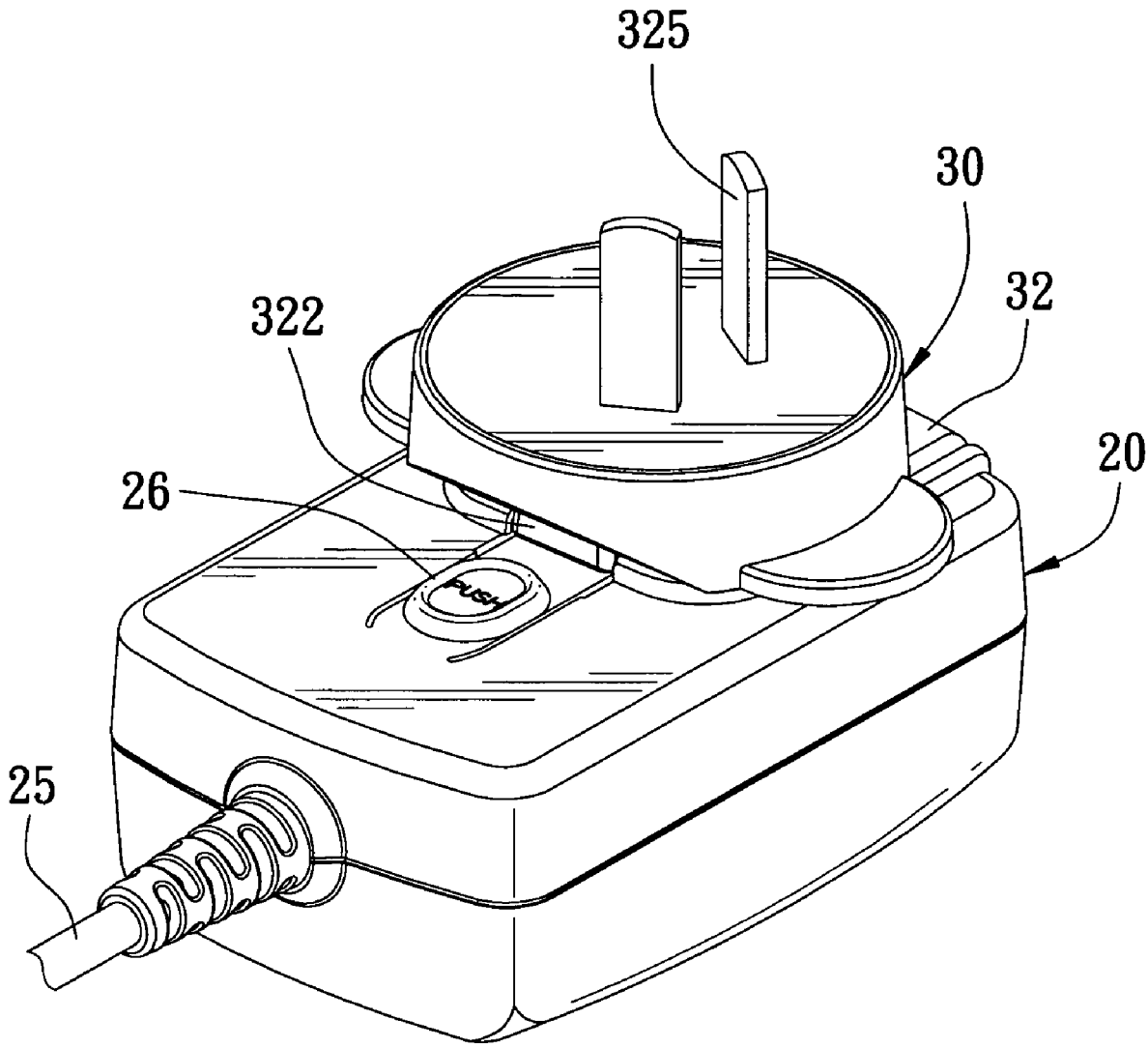
FIG. 6 is a perspective view of the first preferred embodiment of the power source supplier assembled thereon with another different-structured plug in the present invention.

The plug 30 to be inserted in the recess 21 of the main body 20 consists of a bottom plate 31 and a socket 32. The socket 32 has its lower portion bored with an accommodating hollow 321 and the bottom plate 31 is covered on the accommodating hollow 321. The bottom plate 31 has its opposite sides respectively bored with a connecting slot 311 and its central portion bored with a plug fit slot 312. The two connecting slots 311 are respectively to receive the two position-guide blocks 23 of the main body 20. The plug fit slot 312 has one end formed with a round expanded hole 3121 for the position-limiting block 222 of the main body 20 to be inserted therethrough, and the round expanded hole 3121 has its open end formed with an elongate slot 3122 facing the recess 21 of the main body 20 for fitting the coupling member 221 of the main body 20 so as to restrict and fix the position-limiting block 222 of the main body 20 in the accommodating 321 of the socket 32. The socket 32 of the plug 30 has a central portion of its upper rear side disposed with a protruding connecting block 322 bored with an engage groove 323 for elastically engaging the clasping member 261 of the main body 20. Moreover, the socket 32 has its rear lower side fixed with two engage members 324 respectively at the opposite sides of the connecting block 322 to be respectively inserted in the two position-limiting notches 27 of the main body 20. In addition, referring to FIGS. 5 and 6, the accommodating hollow 321 of the socket 32 has its upper inner side disposed with insert pins 325 preset in specifications extending forward. The insert pins 325 respectively have the inner end aligned to the connecting slot 311 of the bottom plate 31 and the front end formed with insert pins 325 of different specifications in order to match with different-structured sockets used in various nations.

In using, referring to FIGS. 3 and 4, to fit the plug 30 in the recess 21 of the main body 20, the expanded hole 3121 of the plug 30 has to be aligned to the plug engage block 22 first to enable the position-limiting block 222 to be positioned in the accommodating hollow 321 of the plug 30, and simultaneously the two position-guide blocks 23 are respectively fitted in the two connecting slots 311 and have their upper ends positioned in the accommodating hollow 321. Subsequently, the plug 30 is pushed downward to let the coupling member 221 of the main body 20 slide in the elongate slot 3122 of the plug 30 and the position-limiting block 222 of the main body 20 restricted to position in the accommodating hollow 321 of the plug 30 by the elongate slot 3122. At this time, the two elastic conducting strips 24 respectively positioned in the position-guide blocks 23 have their upper contact ends 241 positioned in the accommodating hollow 321 and respectively conducted with the inner ends of the insert pins 324 of the plug 30. Meanwhile, the clasping member 261 of the press button 26 of the main body 20 is elastically engaged in the engage groove 323, and the connecting block 322 has its opposite edges respectively inserted in the two position-limiting notches 27 of the main body 20. Thus, the plug 30 can be firmly fixed on the main body 20. To remove the plug 30 from the main body 20, only press the press button 26 to let the clasping member 261 of the main body 20 disengaged from the engage groove 323 of the plug 30 and then the plug 30 can be removed from the main body 20 with steps contrary to the inserting operation.

By so designing, the two elastic conducting strips 24 are respectively covered by the two position-guide blocks 23, having only a little part of their upper contact ends 241, which contacts with the inner end of the insert pin 324, exposed to the outside; therefore, the elastic conducting strips 24 can be protected from being damaged by external force. In addition, the plug 30 has its socket 32 covered by the bottom plate 31 for protection, able to prevent a user from touching the insert pins 325 and causing an accident.

Figure 7:
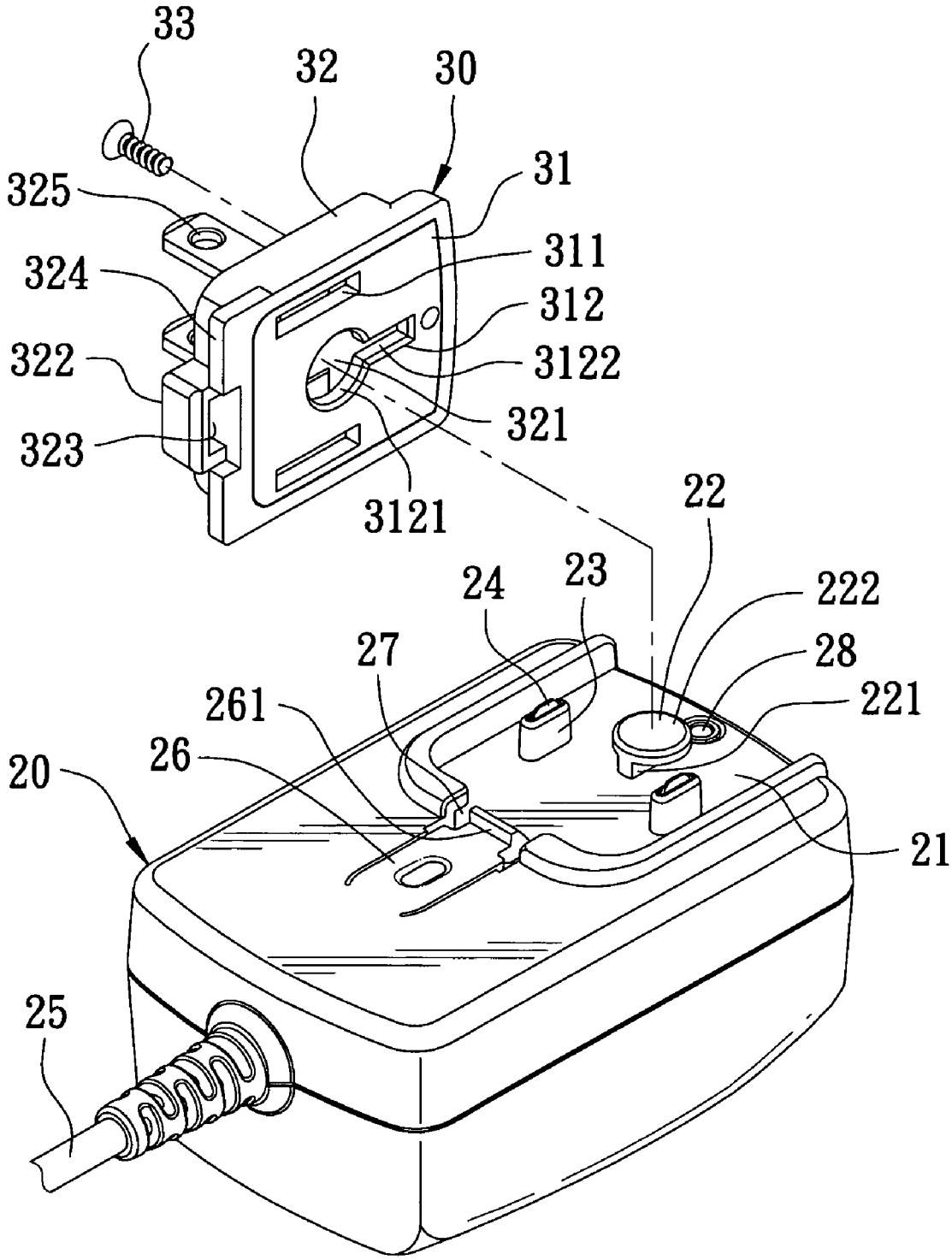
FIG. 7 is an exploded perspective view of a second preferred embodiment of a power source supplier able to change its plug in the present invention.

A second preferred embodiment of a power source supplier able to change its plug in the present invention, as shown in FIG. 7, has almost the same structure as that described in the first preferred embodiment, except that the main body 20 is bored with a threaded hole 28 in the recess 21 and the plug 30 is provided with a bolt 33. After fitted in the recess 21 of the main body 20, the plug 30 can be firmly secured on the main body 20 by screwing the bolt 33 into the threaded hole 28. In addition, the press button 26 is concavely provided in the main body 20; therefore, the press button 26 cannot easily be pressed without the help of tools, thus preventing young children from removing the plug 30 casually and causing an accident.

Figure 8:
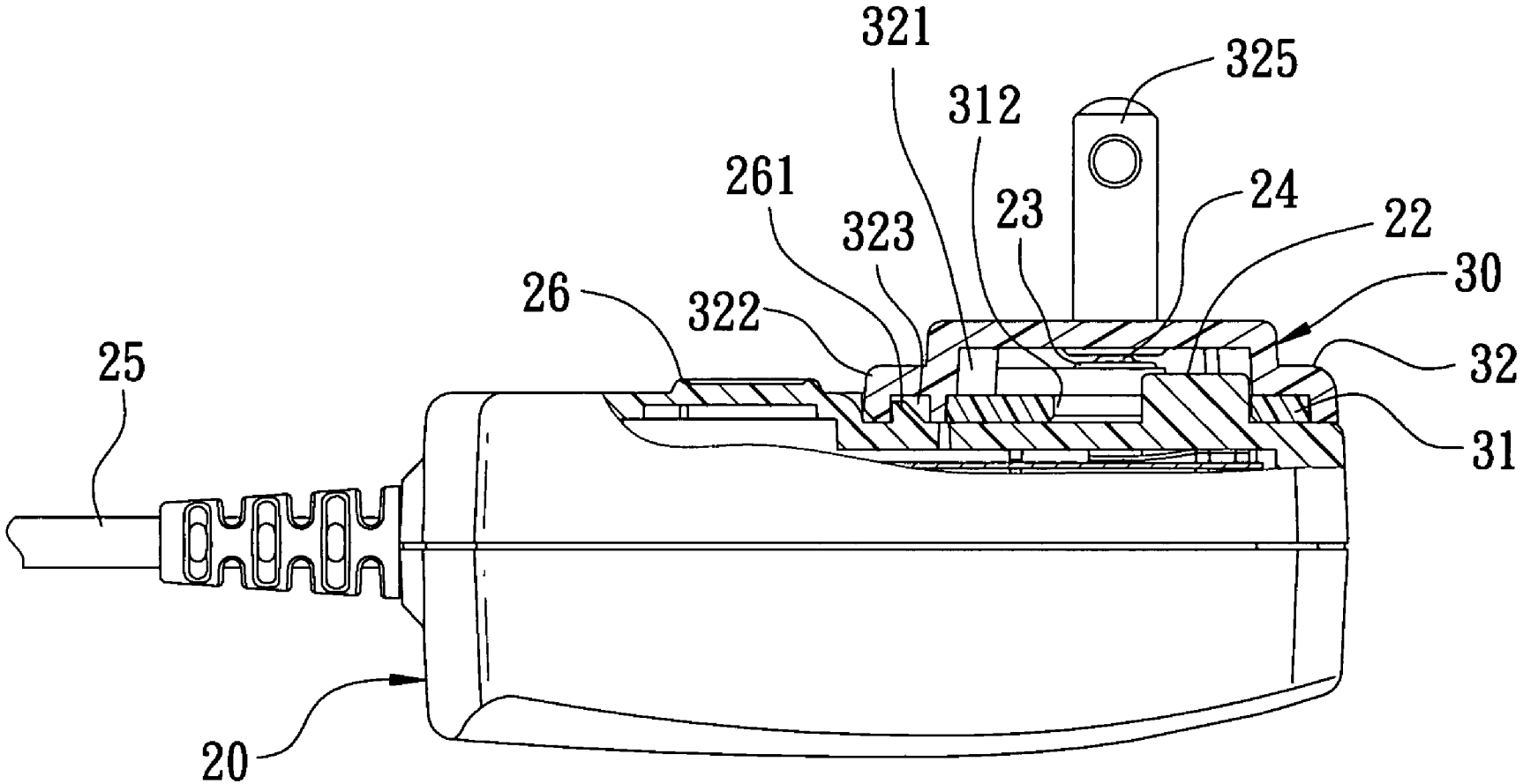
FIG. 8 is a side cross-sectional view of a third preferred embodiment of a power source supplier able to change its plug in the present invention.

A third preferred embodiment of a power source supplier able to change its plug in the present invention, as shown in FIG. 8, has almost the same structure as that of the second preferred embodiment, except that the clasping member 261 of the press button 26 is provided beneath the recess 21 of the main body 20 without protruding out of the recess 21, thus preventing the clasping member 261 from being broken by a external force.

As can be understood from the above description, this invention has the following advantages.

1. The two position-guide blocks function to protect the two elastic conducting strips from being damaged, able to prolong the service life of the power source supplier.

2. The bottom plate is covered on the socket for protection, able to prevent the insert pins from being touched and causing an accident and insure safety in use.

3. During assembling the plug on the main body, only after the two position-guide blocks and the plug engage block of the main body are respectively fitted in the two connect slots and the expanded hole of the plug engage slot of the plug, can the plug be firmly fixed on the main body, elevating accuracy in positioning and preventing the position-guide blocks and the plug engage block from being damaged.

4. The two elastic conducting strips are respectively provided with a fit end to be directly fitted with the fit head of an electric wire, facilitating assembly and lowering cost.

While the preferred embodiments of the invention have been described above, it will be recognized and understood that various modifications may be made therein and the appended claims are intended to cover all such modifications that may fall within the spirit and scope of the invention.

I claim:

1. A power source supplier able to change its plug comprising a main body and a plug:

Said main body having its topside formed with a recess having an open end at a preset side, said recess fixed therein with a projecting plug engage block, said plug engage block having coupling member extending upward vertically from said recess, said coupling member having its free end expanding sideward to form a position-limiting block, said main body disposed in the interior with elastic conducting strips preset in number and protruding out of said recess, said main body bored with position-limiting notches preset in number at the lower opposite sides of said recess, said main body further provided with press buttons preset in number, said press button having its free end formed with a clasping member positioned in said recess: and Said plug fitted with said recess of said main body, said plug formed with an accommodating hollow, said plug having its rear side bored with a plug engage slot and plural connecting slots, said plug engage slot and connecting slots communicating with said accommodating hollow, said accommodating hollow of said plug having its upper inner side disposed with insert pins preset in number and extending toward the front end at the locations corresponding to said connecting slots, said insert pins respectively connected with said elastic conducting strips of said main body, said plug engage slot of said plug formed with a round expanded hole matching with said position-limiting block of said main body, said round expanded hole formed with a elongate slot facing the open end of said recess of said main body, said plug having its peripheral edge provided with two engage members respectively matching with said two position-limiting notches of said main body, said plug having its upper rear edge fixed with a connecting block corresponding to said press button of said main body, said connecting block having its rear side bored with an engage groove aligned to said clasping member of said main body.

2. The power source supplier able to change its plug as claimed in claim 1, wherein said plug is composed of a bottom plate and a socket, said bottom plate bored with two said connecting slots and one said plug engage slot, said socket having its bottom side bored with the accommodating hollow, said bottom plate firmly covered on said accommodating hollow.

3. The power source supplier able to change its plug as claimed in claim 1, wherein each said elastic conducting strip has its upper contact end protruding out of said recess and has its bottom side extending vertically and forming an elastic member, said elastic member having its outer end extending toward the opposite sides and forming a coupling member, said coupling member having its upper side secured on said main body and its lower side provided with a fit member, an electric wire of said main body provided with a fit head to be fitted with said fit member of said elastic conducting strip.

4. The power source supplier able to change its plug as claimed in claim 1, wherein said press button is disposed at the opposite side of an open end of said recess, said recess having its lower side bored with the two position-limiting notches respectively positioned at opposite sides of said press button, said plug provided with said connecting block matching with said press button of said main body, said two engage members respectively positioned at the opposite sides of said connecting block.

5. The power source supplier able to change its plug as claimed in claim 4, wherein said clasping member of said press button is positioned beneath said recess.

6. The power source supplier able to change its plug as claimed in claim 4, wherein said clasping member of said press button is positioned on the topside of said recess.

7. The power source supplier able to change its plug as claimed in claim 4, wherein said press button is protrudently positioned on said main body.

8. The power source supplier able to change its plug as claimed in claim 4, wherein said press button is concavely positioned in said main body.

9. The power source supplier able to change its plug as claimed in claim 1, wherein said two elastic conducting strips are respectively positioned in parallel at the opposite sides of said plug engage block of said main body, and two hollow position-guide blocks are respectively fixed at the opposite sides of said recess for respectively receiving said two elastic conducting strips therein, said two elastic conducting strips respectively having their upper ends a little protruding out of the topside of said hollow position-guide blocks.

10. The power source supplier able to change its plug as claimed in claim 1, wherein said recess of said main body is bored with a threaded hole at a preset location and said plug is provided with a bolt to be screwed with said threaded hole.

* * * * *